US009332800B2

(12) United States Patent
Brown

(10) Patent No.: US 9,332,800 B2
(45) Date of Patent: May 10, 2016

(54) HELMET STRUCTURE WITH COMPRESSIBLE CELLS

(71) Applicant: George Malcolm Brown, New London, CT (US)

(72) Inventor: George Malcolm Brown, New London, CT (US)

( * ) Notice: Subject to any disclaimer, the term of this patent is extended or adjusted under 35 U.S.C. 154(b) by 22 days.

(21) Appl. No.: 14/025,934

(22) Filed: Sep. 13, 2013

(65) Prior Publication Data

US 2014/0068841 A1 Mar. 13, 2014

Related U.S. Application Data

(60) Provisional application No. 61/700,511, filed on Sep. 13, 2012.

(51) Int. Cl.
*A42B 3/12* (2006.01)

(52) U.S. Cl.
CPC ..... *A42B 3/122* (2013.01); *A42B 3/121* (2013.01)

(58) Field of Classification Search
CPC ..... A42B 3/125; A42B 3/12; A42B 3/121; A42B 3/064; A42B 3/069; A42B 3/127; A42B 3/00; A42B 3/124; A42B 3/10; A42B 3/122; A42B 3/06; A42B 3/281; A41D 13/015; A41D 13/0155; A41D 3/05; A63B 71/10; F41H 1/04
USPC ..... 2/411–414, 425
See application file for complete search history.

(56) References Cited

U.S. PATENT DOCUMENTS

| | | | | |
|---|---|---|---|---|
| 5,204,998 | A * | 4/1993 | Liu | 2/411 |
| 5,950,244 | A * | 9/1999 | Fournier et al. | 2/414 |
| 7,895,681 | B2 * | 3/2011 | Ferrara | 2/455 |
| 8,566,968 | B2 * | 10/2013 | Marzec et al. | 2/411 |

* cited by examiner

*Primary Examiner* — Andrew W Collins
(74) *Attorney, Agent, or Firm* — McCormick, Paulding & Huber LLP

(57) ABSTRACT

A helmet structure without any hard outer shell has axially compressible cell units contained in a hemispheric frame by a thin fabric covering stretched over cup shaped cell retainers that have sidewalls of compressible foam. The frame is supported on the wearer's head on plastic foam posts that space the inner ends of compressible bladders from the wearer's head, and ambient air in the bladders compresses at impact, being vented then through openings for gradually absorbing such impact forces. Each bladder is vented into a space between the cup "bottom" and the outer end of a bladder. At least two cell sizes are provided, and some of these are on depending lobes in the frame, for protecting the wearer's ears and neck.

21 Claims, 5 Drawing Sheets

HELMET STRUCTURE WITH COMPRESSIBLE CELLS

CROSS REFERENCE TO RELATED APPLICATIONS

This application claims priority to and incorporates by reference U.S. Provisional Application Ser. No. 61/700,511 filed Sep. 13, 2012.

FIELD OF THE INVENTION

This invention relates to protective headgear for use in contact sports such as American football. More specifically, it relates to eliminating the relatively hard plastic outer shell common in prior art helmet designs, such as shown for example in U.S. patents to Ferrara, particularly U.S. Pat. No. 7,895,681.

In Ferrara, a plurality of impact absorbing units are arranged inside a relatively stiff plastic shell, which abuts an outer end of each unit, the inner end engaging the head of the wearer. Before impact forces can be absorbed however by one or more of these units, the hard outer shell itself creates a rebound action, similar to that of conventional helmets when one player's helmeted head strikes that of another player.

BACKGROUND OF THE INVENTION

Head on impacts are quite common in spite of recent attempts to limit such tactics in American football. The relatively hard plastic, commonly used in conventional football helmets, virtually assures that initial impact and rebound forces will lead to concussions on the playing field. And, the snugger the fit on the head of the wearer of prior art helmets, the more these forces are felt on the wearer's head and skull when two players heads meet, whether intentionally or by accident during any contest calling for bodily contact.

SUMMARY OF THE INVENTION

In accordance with the present invention, a helmet structure without any hard outer shell is disclosed, with a more readily yieldable structure, that includes a plurality of compressible cells uniquely supported in a generally hemispherical frame of high strength plastic, such as nylon. Each cell is relatively free to move in it's associated frame opening, as a result of it's outer end being restricted solely by an outer covering of thin plastic material rather than the hard plastic material commonly believed necessary in any football helmet. Preferably, each cell includes an inverted cup shaped retainer portion made, in part at least, from a relatively yieldable plastic foam. These retainers house the outer ends of axially compressible cell bladders. These retainer cups, in combination with short support posts of foam plastic, supported in the frame, hold the cell bladders in spaced relation to the head of the wearer, allowing free circulation of air inside the resulting helmet structure.

DETAILED DESCRIPTION

Figure 1:
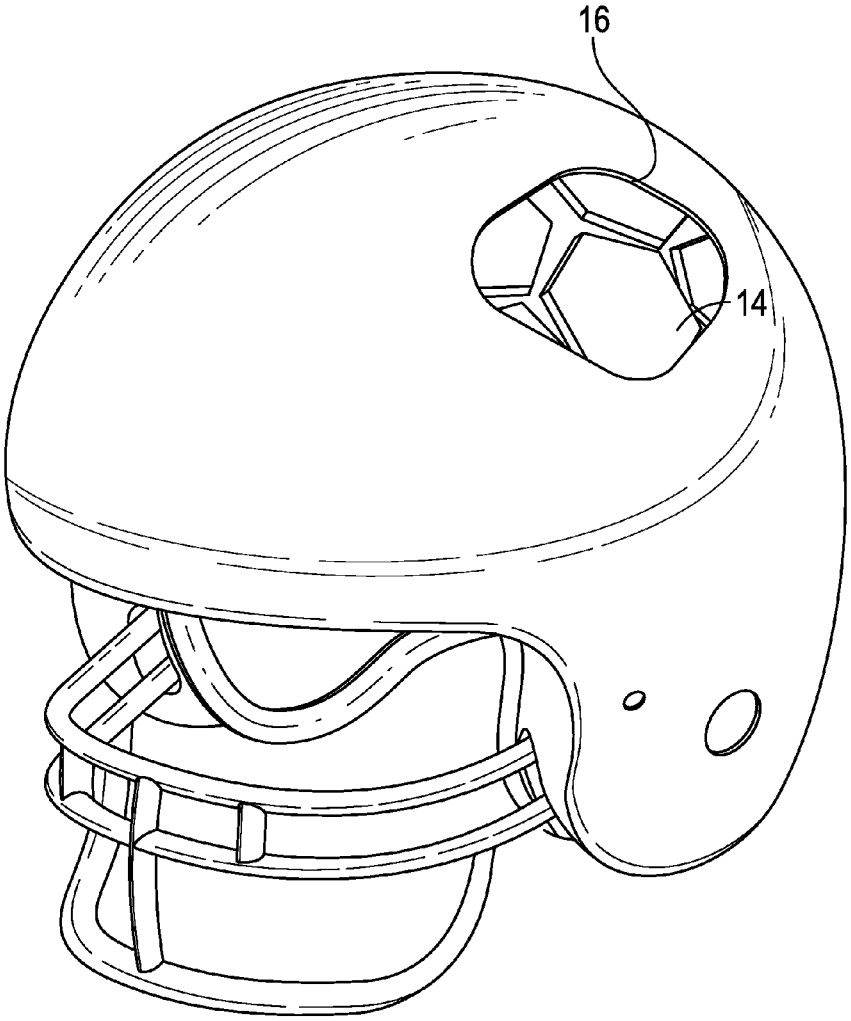
FIG. 1 shows, in perspective, a preferred embodiment of my helmet structure with a portion of the outer fabric skin covering cut away to reveal several individual cells.
Figure 3:
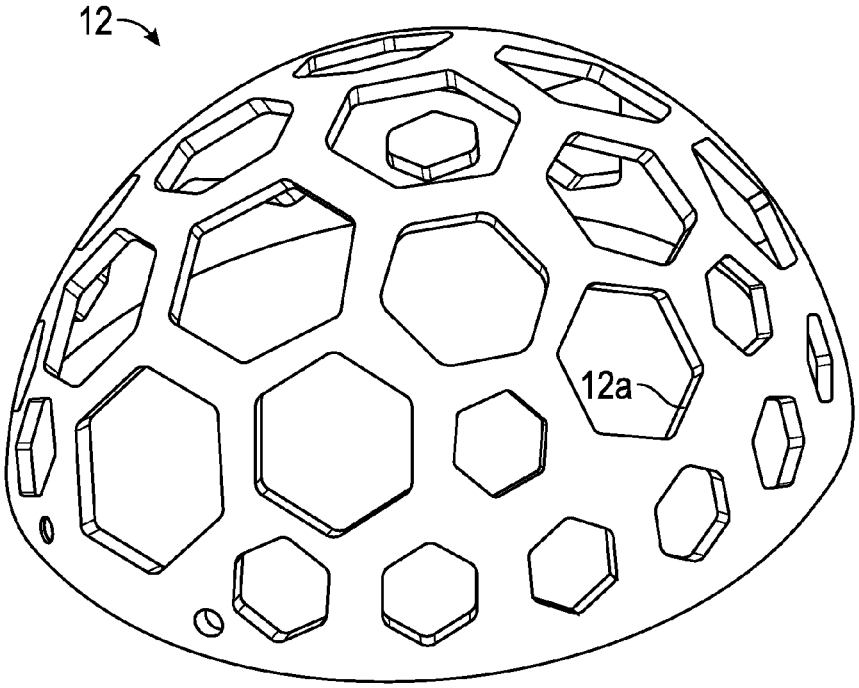
FIG. 3 shows, in perspective, the upper hemi-spherically shaped frame portion that slidably supports the individual axially compressible retainer cells and cups.

My helmet structure is designed to avoid the presumed need for a hard plastic outer shell, and to instead meet the helmet's structural requirements by providing a one or two piece, floating frame 12 (FIG. 3) that is of high strength plastic, such as nylon, and defines a plurality of cell openings, 12*a*, 12*a*, preferably of hexagonal shape for receiving hexagonally shaped retainer cups 14, 14 in an array that minimizes the interstices between these retainer cups, as suggested in FIG. 1.

An outer fabric skin/covering 16 is wrapped around these retainers 14, 14 and will not offer resistance to impact as in conventional hard shell helmets, but instead serves to transfer such forces to the retainer cups 14, 14, and thence to the cell bladders therein. Preferably and as shown, these openings are of at least two sizes, the larger sized openings being adjacent the hemispherical pole, and also adjacent the front thereof. Smaller size openings are also arranged in the hemispherical frame, chiefly adjacent the periphery of the hemisphere.

In further accordance with my preferred design, the frame 12 of my helmet structure has inwardly projecting soft foamed plastic posts 18,18 that loosely support the helmet structure on the wearer's head in a way that provides air circulation and consequent cooling, for the wearer. In addition, the design affords a looser fit on the wearer's head. I have found that the snugger the fit of the helmet, the more severe the impact sustained by the wearer's head, due to the reduction in available displacement for the components inside the helmet intended to protect the head. The nylon frame 12 provides both resiliency and strength for the helmet structure, yet is spaced from both the wearer's head and the impact forces from another player's helmet striking the wearer's helmet's during any "hit".

Figure 4:
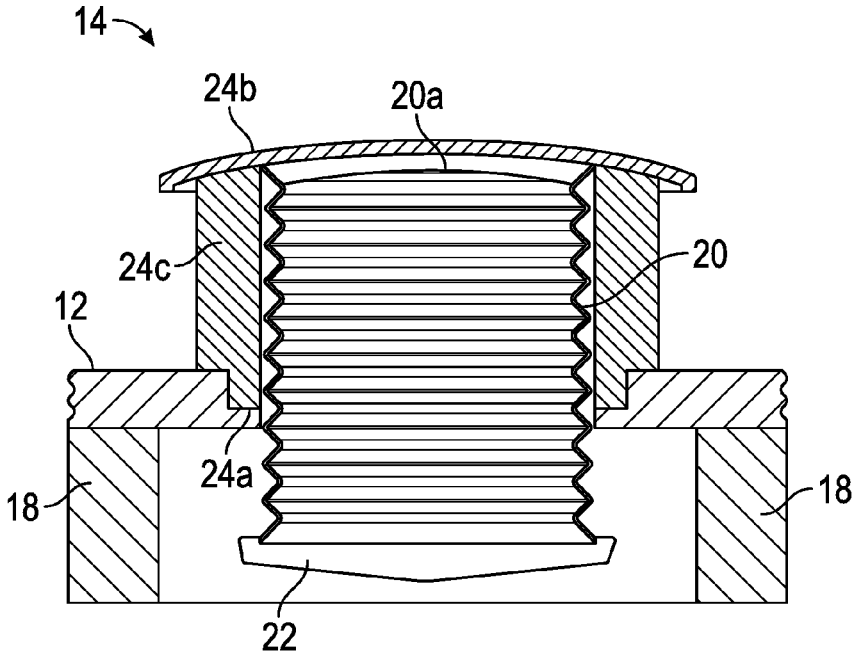
FIG. 4 shows an individual cell, with the hexagonal cup shaped retainer cut away, and the compressible cylindrical bladder, with its end pad. This bellows shape cell extends well beyond the frame. Short plastic foam posts on the inner side of the frame space the padded inner end of each bladder outwardly of the wearer's head.
Figures 5A, 5B, 5C:
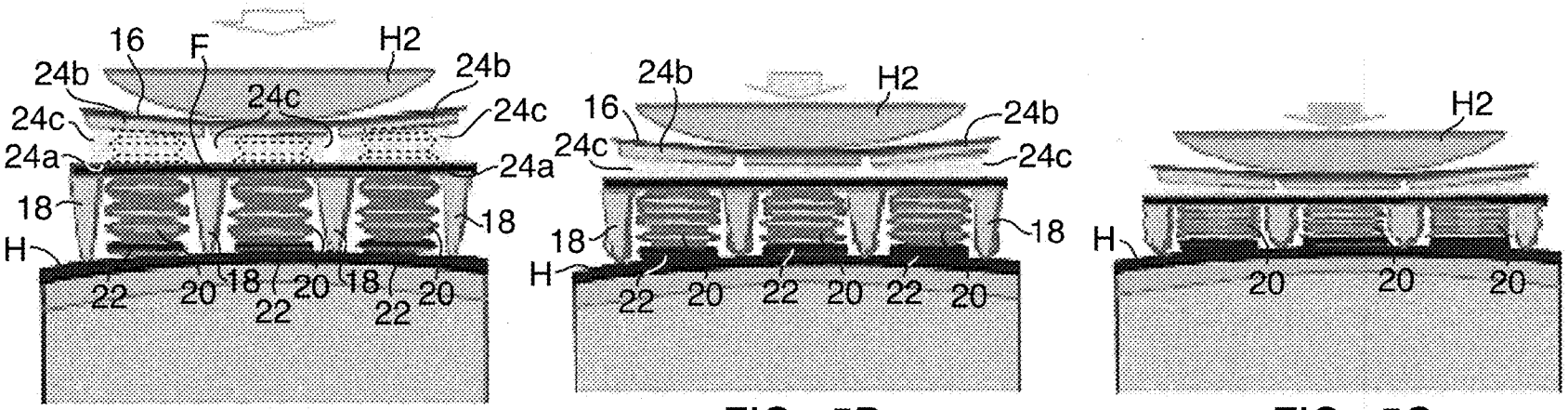
FIGS. 5A, 5B, and 5C, show, in a sequence of views, the deformation during impact, as by another's helmet striking that of one wearing a helmet of my design.
Figure 6A:
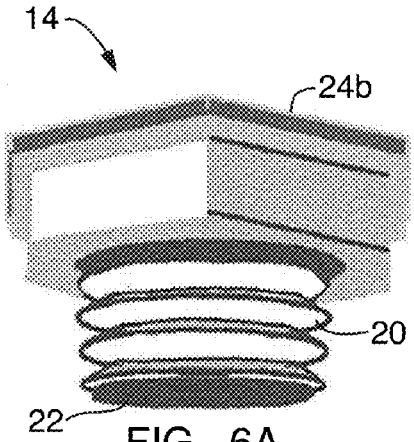
FIGS. 6A-6C show an individual cell with its hexagonal retainer cup and generally cylindrical bellows/bladder, including also the vent opening defined at the outer end in the space between the outer end of the bellows and the closed end of the retainer cup.
Figure 6B:
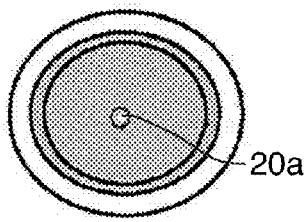
Figure 6C:
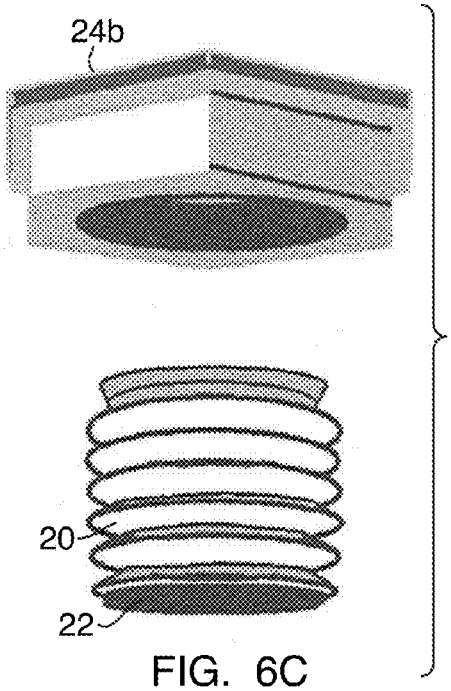

The above results can be illustrated with reference to the sequence of views depicted in FIGS. 5A-5C, wherein FIG. 5A shows the initial configuration at the moment of first contact, and FIG. 5B the results following compression of the plastic posts 18,18 and creating contact between the inner padded ends of the axially compressible cell portions or bellows 20, 20 and the wearer's head H. Each cell includes an outer portion24 of inverted cup shape such that the cup rim 24*a* abuts the frame 12 and the cup "bottom" 24*b* contacts the outer fabric-like skin16. Each cell bladder portion has a padded inner end, 22 and an outer end spaced from the cup "bottom" as best shown in FIG. 4. Each cell bladder is hollow and contains air at ambient pressure. As the bladder compresses during impact (FIG. 5C) this air compresses until some of that air can escape through the vent opening 20*a* at the outer end of the bellows/ cell just inside the "bottom" of the retainer cup.

Each cell bladder 20 is preferably of the bellows type, circular in cross section, and with circular pleats for maximum flexibility. The outer end is vented as described above, and the inner end has a compressible pad. The retainer cup is hexagonally shaped as is the flanged end cap extending slightly beyond the hexagonally shaped cup sidewalls.

The sidewall 24*c* of each retainer cup 24 is of compressible plastic foam and as the axially compressible bladders yield, these plastic foam cup sidewalls compress offering additional resistance to the impact forces from a "hit", such as that from another player, particularly, from his helmet. The preferred plastic foam material is of closed cell urethane with moderate to higher resistance to deformation than that of the posts 18, 18. The hexagonally shaped retainer cup end cap protects the plastic foam from direct impact and provides better nesting of these units within the hemi-spherically shaped contour of the helmet structure (see FIG. 1). These end caps define a space between the "bottom" of the retainer cup and the vented outer end of the bellows to allow air to escape during impact, a result facilitated by the hexagonal shape of the cup and the cylindrical shape of the bellows.

The helmet's outer skin covering is stretched tightly over the closely spaced hexagonal retainer cup bottoms, as described previously, and this outer covering is preferably of no more than ⅛ inches in thickness so that it will allow any impact forces to be absorbed by several adjacent cells, and not by a single impacted cell. Preferably, this outer skin is made from a woven fabric coated with PTFE (Teflon) to provide the requisite modulus for such an outer skin on a helmet. The nylon frame itself is designed to facilitate this load sharing among neighboring cells, all as suggested in FIGS. 5A-5C. As a corollary to this propensity for sharing impact loads, I also note that the results could be further enhanced if players from both teams on the football field wear helmets of the design described herein. This would obviously decrease even further the severity of concussions, especially those from direct head to head impacts.

Figure 2:
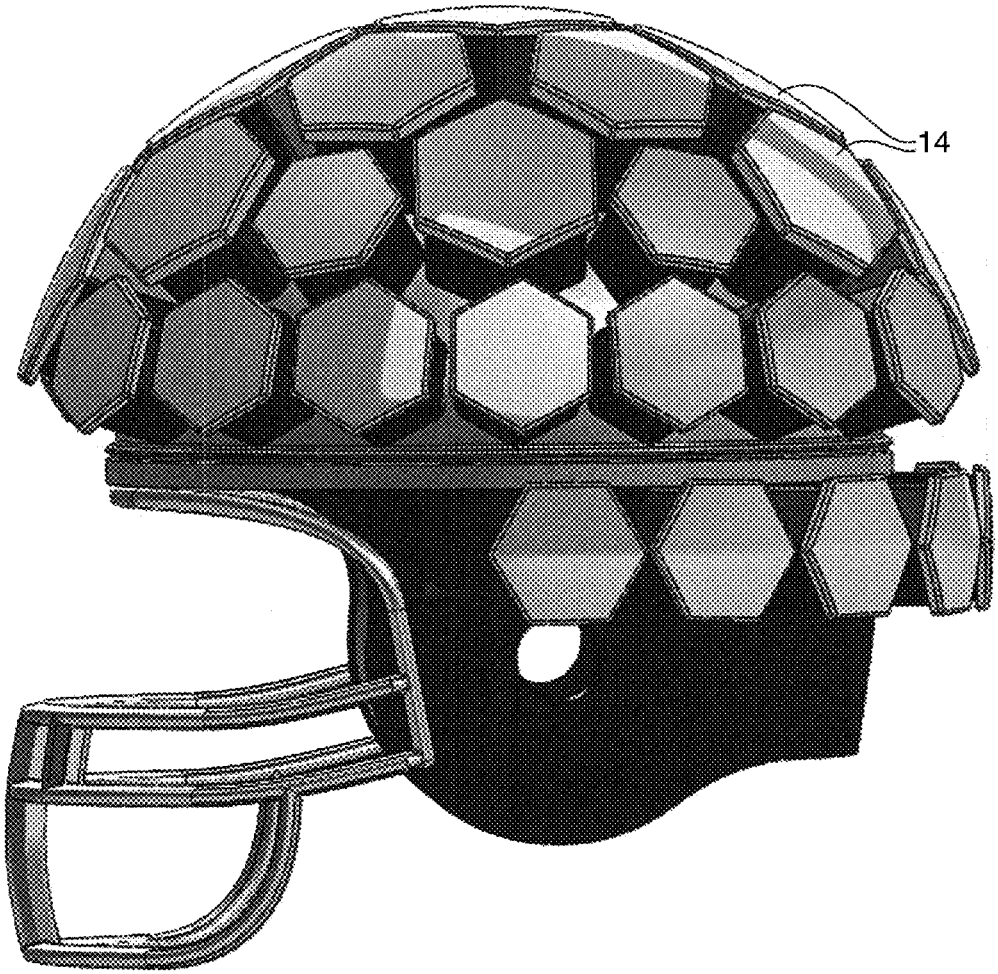
FIG. 2 shows, in side elevation, the helmet structure of FIG. 1 with the outer skin covering removed

As best shown in FIG. 2, the hemispherical frame 12 also includes depending protective lobes covering both ears of the wearer, as well as the back of his neck. Additional compressible cells or units are preferably mounted in the region adjacent to the hemispherical frame, and these units function in much the same manner as those described previously. A protective face guard is secured to these lobes and may also be secured to the lower front edge of the hemi-spherically shaped frame as suggested in FIG. 2. If desired, these lobes may be formed separately from the hemi-spherical frame, and these components fitted together at their respective peripheries as suggested in FIG. 2. Alternatively, the frame might be molded to form these components in a single integral structure. The faceguard might be molded with several integrally formed nubs that snap into sockets molded into the leading edge of the lobes and/or the peripheral front edge of the hemispherical frame itself. Such a construction would facilitate detachment of the faceplate should an opposing player illegally grab the wearer's helmet by the faceplate.

In summary, the collapsible plastic urethane foam posts or pins readily compress and then the cup side walls offer resistance as the bellows shaped air filled cell bladders become pressurized. The compressible foam cup sidewalls thus contribute to the overall effect of very low impact force at the wearer's head. In effect, the helmet design described herein, will significantly reduce the impact force felt at the wearer's head by increasing the time interval for absorption of that impact force. In a force vs. time plot, the area under the respective plots for a conventional helmet and for one of my improved design will be substantially different. The increased time, over which the impact force acts, with my design will reduce significantly the peak force that occurs, and consequently reduce the rebound effect from that of a conventional hard shell helmet.

Concussions are to be feared in all contact supports, especially in football, the more so in youth football, where concussions can be of greatest concern. Providing a helmet structure that provides for incremental energy absorbing movement of many components represents a significant departure from the conventional wisdom of hard shell helmet that when struck with an impact (Force X Time), simply reflects this same momentum back as a result of the restitutional characteristics of the hard plastic helmet shell itself. My invention eliminates the hard plastic shell, thereby avoiding the consequences of the hard material thought necessary to provide protection against concussions in general.

What is claimed is:

1. A helmet structure for protecting a wearer's head, and comprising:

a generally hemispherical frame of having a plurality of through openings arranged in a hemispherical array, said openings being of at least two sizes, larger size openings disposed adjacent the pole of the hemisphere, smaller size openings adjacent the periphery of said hemispherical frame, a plurality of compressible cells provided in said frame openings, each cell including an inverted cup shaped retainer portion having an inner frame engaging cup lip, and each cell including an axially compressible cell bladder provided in part within said cup shaped retainer portion, each said cell bladder having an inner portion extending inwardly beyond said frame, a plurality of resiliently deformable plastic posts projecting inwardly of said frame so as to normally abut the head of the wearer, and normally extending beyond the inner ends of said cell bladders so as to locate said cell bladder inner ends in outwardly spaced relation to the wearer's head, an outer covering of high tensile strength stretched around and abutting outer end portions of said cup shaped retainer portion, and spaced from said frame, by the depth of cup shaped retainer sidewalls, said sidewalls adapted to absorb impact forces by compressive deformation.

2. The helmet structure of claim 1 wherein certain of said compressible cells contain ambient air, and define at least one vent opening of a size that restricts air out flow during compression.

3. The helmet structure of claim 1 wherein said frame is fabricated from a plastic material having an elastic modulus of at least 200,000 pounds per square inch, and a thickness of approximately $5/16^{th}$ of an inch.

4. The helmet structure of claim 1 wherein said pliable outer covering is fabricated from a plastic material having a thickness of no more than $1/16^{th}$ inch.

5. The helmet structure of claim 1 wherein said cup shaped retainers have slightly convex outer end caps contoured to provide a generally smooth curvature for said outer covering.

6. The helmet structure of claim 1 wherein said frame openings are of hexagonal shape and receive retainer cup side-walls of corresponding shape.

7. The helmet structure of claim 1 wherein said frame further includes depending lobe portions defining openings for receiving additional compressible cells.

8. The structure of claim 1 wherein said axially compressible cell bladder includes at least one vent opening located between the inside of said retainer cup bottom wall and the outer end of said cell bladder.

9. The helmet structure of claim 2 wherein said frame is fabricated from a plastic material having an elastic modulus of at least 200,000 pounds per square inch, and a thickness of between $3/16^{ths}$ and $5/16^{th}$ of an inch.

10. The helmet structure of claim 9 wherein said outer covering is fabricated from a plastic material having a thickness of less than $3/16^{ths}$ inch.

11. The helmet structure of claim 10 wherein said cup shaped retainers have slightly convex outer end caps contoured to provide a generally hemispherical shape for said outer covering.

12. The helmet structure of claim 11 wherein said frame openings are of hexagonal shape and receive correspondingly shaped retainer cup side-walls.

13. The helmet structure of claim 12 wherein said frame further includes depending lobe portions defining openings for receiving additional compressible cells.

14. The helmet structure of claim 13 wherein said axially compressible cell bladder includes at least one vent opening located between the inside of said retainer cup bottom well and the outer end of said cell bladder.

15. The helmet structure of claim 3 wherein said cup shaped retainers have slightly convex outer end caps contoured for defining the shape of said outer covering.

16. The helmet structure of claim 15 wherein said frame openings are of hexagonal shape and receive correspondingly shaped retainer cup side-walls.

17. The helmet structure of claim 16 wherein said frame further includes depending lobe portions defining openings for receiving additional compressible cells.

18. The helmet structure of claim 17 wherein said axially compressible cell bladder includes at least one vent opening located between the inside of said retainer cup bottom well and the outer end of said cell bladder.

19. The helmet structure of claim 4 wherein said frame openings are of hexagonal shape and receive correspondingly shaped retainer cup side-walls.

20. The helmet structure of claim 19 wherein said frame further includes depending lobe portions defining openings for receiving additional compressible cells.

21. The helmet structure of claim 20 wherein said axially compressible cell bladder includes at least one vent opening located between the inside of said retainer cup bottom well and the outer end of said cell bladder.

* * * * *